US006900433B2

(12) United States Patent
Ding

(10) Patent No.: US 6,900,433 B2
(45) Date of Patent: May 31, 2005

(54) METHOD AND APPARATUS FOR EJECTING IONS FROM A QUADRUPOLE ION TRAP

(75) Inventor: Li Ding, Manchester (GB)

(73) Assignee: Shimadzu Research Laboratory (Europe) Ltd., Manchester (GB)

( * ) Notice: Subject to any disclaimer, the term of this patent is extended or adjusted under 35 U.S.C. 154(b) by 0 days.

(21) Appl. No.: 10/451,579

(22) PCT Filed: Nov. 29, 2001

(86) PCT No.: PCT/GB01/05264

§ 371 (c)(1),
(2), (4) Date: Nov. 4, 2003

(87) PCT Pub. No.: WO02/50866

PCT Pub. Date: Jun. 27, 2002

(65) Prior Publication Data

US 2004/0079875 A1 Apr. 29, 2004

(30) Foreign Application Priority Data

Dec. 21, 2000 (GB) ..... 0031342

(51) Int. Cl.[7] ..... H01J 49/42
(52) U.S. Cl. ..... 250/292; 250/282
(58) Field of Search ..... 250/282, 292

(56) References Cited

U.S. PATENT DOCUMENTS 3,920,985 A 11/1975 Hiller et al.
5,248,882 A * 9/1993 Liang ..... 250/282

FOREIGN PATENT DOCUMENTS

SU 1088090 4/1984
SU 1660075 A1 6/1991
WO WO 01/29875 A2 4/2001

OTHER PUBLICATIONS

Waldren, et al., The Quadrupole Ion Store (Quistor). Part III Studies on Phase–Synchronised Ion Ejection: The Effection of Ejection Pulse Width And Detection Pulse Delay, International Journal of Mass Spectrometry and Ion Physics, 1979, pp. 315–335, vol. 29, Elsevier Scientific Publishing Company, Amsterdam.
Sheretov et al., Modulation Parametric Resonances and Their Influence on Stability Diagram Structure, International Journal of Mass Spectrometry, Apr. 1998, pp. 207–216, vol. 184, Elsevier Scientific Publishing Company, Amsterdam.
Bonner et al., Ion–Molecule Reaction Studies With A Quadrupole Ion Storage Trap, International Journal of Mass Spectrometry and Ion Physics, Dec. 1972, pp. 197–203, vol. 10, No. 2, Elsevier Scientific Publishing Company, Amsterdam.

(Continued)

*Primary Examiner*—Jack I. Berman
(74) *Attorney, Agent, or Firm*—Leydig, Voit & Mayer, Ltd.

(57) ABSTRACT

A method for ejecting ions from a quadrupole ion trap includes creating a digital control signal, using the digital control signal to control the timing of a switch unit to generate a time-varying rectangular wave voltage, supplying the rectangular wave voltage to the ion trap to trap ions in a predetermined range of mass-to-charge ratio, and varying the duty cycle of every nth wave of the rectangular wave voltage (where n is an integer greater than 1) to cause ejection of ions having a predetermined mass-to-charge ratio. The method can be used for analysis of mass-to-charge ratio by adjusting the frequency of the rectangular wave voltage to select a starting point for scanning mass-to-charge ratio, and then varying the frequency while the duty cycle is being varied to cause ejection of trapped ions, in sequence, according to mass-to-charge ratio.

33 Claims, 5 Drawing Sheets

OTHER PUBLICATIONS

March et al., Practical Aspects of Ion Trap Mass Spectrometry vol. 1, Fundamentals of Ion Trap Mass Spectrometry, 1995, pp. 4–48, CRC Press, Inc.

Sheretov et al., Theory of the Pulsed Quadrupole Mass Spectrometer, May 1972, pp. 953–962, vol. 42, No. 5, Ryazan Radio Engineering Institute.

Ding et al., Ion Motion in the Rectangular Wave Quadrupole Field and Digital Operation Mode of a Quadrupole Ion Trap Mass Spectrometer, Vacuum Science and Technology, 2001, pp. 176–181.

* cited by examiner

METHOD AND APPARATUS FOR EJECTING IONS FROM A QUADRUPOLE ION TRAP

FIELD OF THE INVENTION

This invention relates to quadrupole mass spectrometry. In particular, the invention relates to a method and apparatus for ejecting ions from a quadrupole ion trap. In a particular, though not exclusive, application of the invention the method and apparatus are used for analaysis of the mass-to-charge ratio of ions.

BACKGROUND OF THE INVENTION

Conventional quadrupole ion trap technology has been developed and practically used for several decades. Literature and patents about this technique is well recorded in the book "Practical Aspects of Ion Trap Mass Spectrometry" edited by R. E. March and J. F. J. Todd. As another approach for driving a quadrupole or, in general, a hyperboloid mass spectrometer, E. P. Sheretov employed a pulse generator to feed the ion trap with the rectangular wave voltage. With this method ions can also be stored and sorted according to their mass-to-charge ratios. Publications about this study date back to the 1970's and the paper titled "Base of the theory of quadrupole mass spectrometers during pulse feeding" (referred to hereinafter as paper 1) by E. P. Sheretov et al published in J. Tech. Phys 42 (1972) gives the fundamental theory of this technique. Because of the flexibility in applying a rectangular wave voltage rather than a sinusoidal harmonic voltage, and also the advances in digital and switching electronic circuitry, this rectangular wave driving technique appeals to the modern concept of instrumentation in mass analysis. Besides the old fashioned mass selective storage mode which is basically suitable for low mass residual gas analysis, work on mass selective instability mode in which ions are scanned through the boundary of the well known "a-q" stability diagram and sequentially ejected and detected has also been reported. In PCT Patent Application No. GB00/03964 there is disclosed a method of mass analysis whereby a rectangular wave voltage is supplied to the ring electrode of a quadrupole ion trap, and further dipole excitation voltage is supplied to the end-cap electrodes in order to generate a mass selective resonant oscillation, which causes mass selective resonant ejection of the ions during a frequency varying mass scan. However, application of a dipole electric field along the z-axis of the ion trap is not the only way to achieve axial resonance excitation. In a paper titled "Modulation parametric resonances and their influence on stability diagram structure" (referred to hereinafter as Paper 2) published in the International Journal of Mass Spectrometry and Ion Processes, E. P. Sheretov gave the theory of ion excitation in a quadrupole electric field whereby any of its parameters such as frequency, amplitude and dc potential is modulated. This led the way to use of the quadrupole electric field alone, say by applying voltage to the ring electrode of quadrupole ion trap, to achieve ion trapping and sorting, as well as resonant excitation which may induce mass selective ion ejection.

Now, by means of ion optical simulation, the present inventor has discovered, inter alia, a practical method whereby mass scanning can be achieved solely by digital processing used to generate a rectangular wave drive voltage, obviating the need to supply a supplementary voltage to the ion trap device.

According to one aspect of this invention, there is provided a method for ejecting ions from a quadrupole ion trap including the steps of creating a digital control signal, using the digital control signal to control the timing of switching means to generate a time-varying rectangular wave voltage, supplying the time-varying rectangular wave voltage to the quadrupole ion trap to trap ions in a predetermined range of mass-to-charge ratio, and varying the duty cycle of every nth wave of the rectangular wave voltage (where n is an integer greater than unity) to cause ejection of trapped ions having a predetermined mass-to-charge ratio.

According to another aspect of the invention there is provided an apparatus for ejecting ions from a quadrupole ion trap including means for creating a digital control signal, switching means for generating a time-varying rectangular wave voltage in response to said digital control signal, the time-varying rectangular wave voltage being effective, when supplied to the quadrupole ion trap, to cause trapping of ions in a predetermined range of mass-to-charge ratio, and means for varying the duty cycle of every nth wave of the rectangular wave voltage (where n is an integer greater than unity) to cause ejection of trapped ions having a predetermined mass-to-charge ratio.

Embodiments of the invention are described, by way of example only, with reference to the accompanying drawings of which:

A mass analyser normally works in co-operation with an ion source. The ion source can be of the kind that generates ions directly inside the ion trap (e.g. a EI source) or of the kind that generates the ion species outside and then introduces them into the ion trap. Once the ions have been introduced into the ion trap, a high frequency voltage should be applied to the electrodes of the ion trap to trap these ions.

Figure 1:
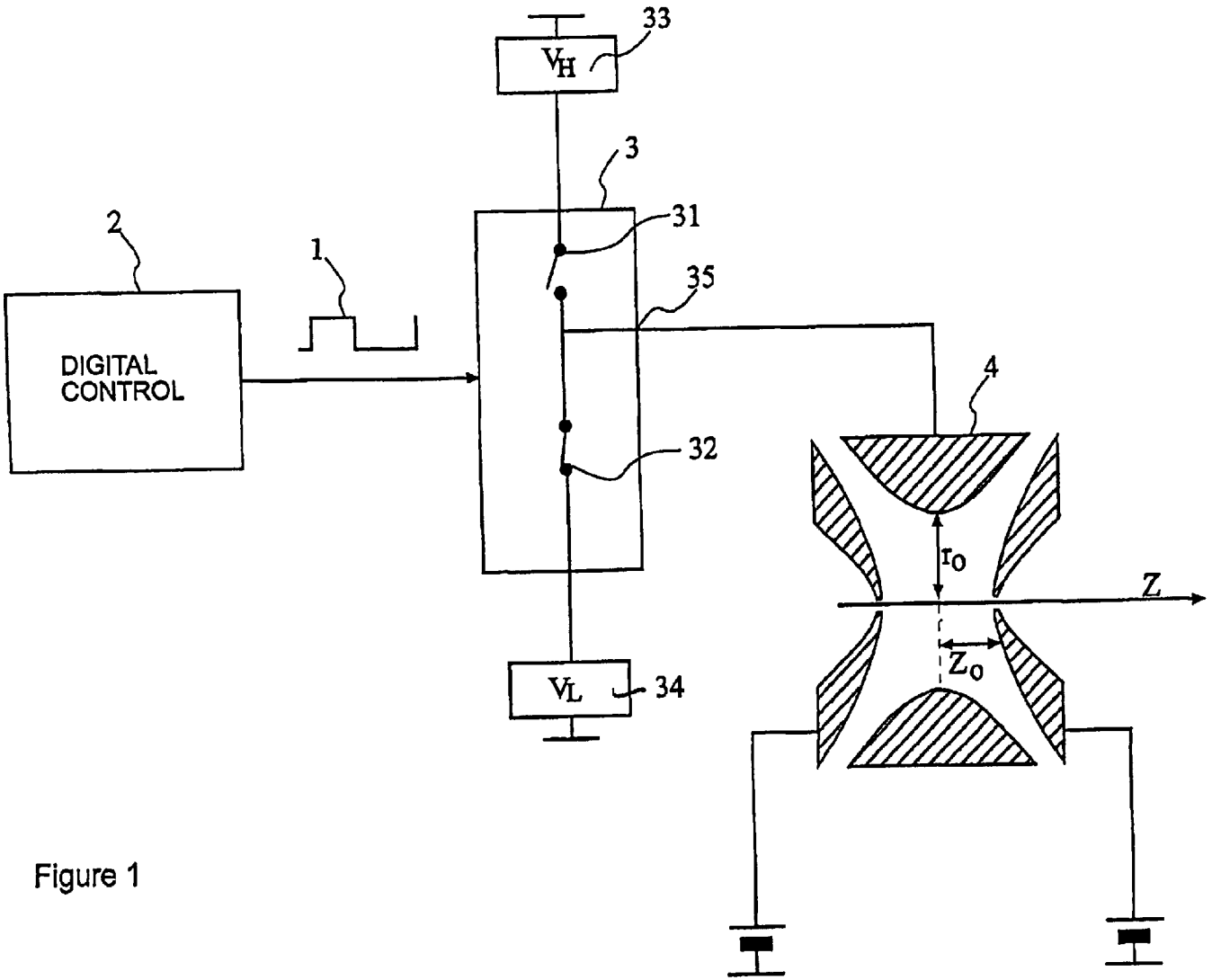
FIG. 1 shows a 3-dimensional quadrupole ion trap driven by a rectangular wave voltage source which is controlled by a digital wave control device.

In FIG. 1, a high frequency digital control signal 1 is generated by a digital control unit 2. In this embodiment, the digital control unit 2 comprises a digital signal processor which may be in the form of a Direct Digital Synthesiser (DDS), a suitable filter and a comparator. The digital signal processor converts clock pulses into an analogue signal which is then subjected to smoothing by the filter. The comparator then compares the smoothed analogue signal with an adjustable threshold and generates the required digital control signal 1 as a result of the comparison. By this means, the timing accuracy of the digital control signal is much better than the period of the clock pulses and so very high frequency resolution of the digital control signal can be achieved. The control signal 1 is then supplied to a high voltage switch circuit 3 to generate the rectangular wave voltage. The high voltage switch circuit 3 includes switches 31 and 32 which are typically bipolar or FET transistors. The two switches 31,32 are connected together in series between a source 33 of a high DC voltage level ($V_H$) and a source 34 of a low DC voltage level ($V_L$). The switches 31,32 are alternately opened and closed in response to the digital control signal 1 so that when one switch is open the other is closed, and vice versa In this manner, the high and low DC voltage levels ($V_H$,$V_L$) are alternately supplied to an output 35 via the switches, thereby generating the time-varying rectangular wave voltage which is supplied to the ion trap. In this embodiment, the output 35 of the switch circuit 3 is connected to the ring electrode 4 of the ion trap and the two end cap electrodes are connected to ground or to a fixed voltage; alternatively, the time-varying rectangular wave voltage could be supplied to the end cap electrodes, the ring electrode being connected to ground or to a fixed voltage.

The high and low DC voltage levels ($V_1$,$V_2$) and the fixed voltage are expressed with respect to a common reference potential (in this case ground), and the fixed voltage can be used to provide a DC bias to offset any DC component U in the rectangular wave voltage, if required.

Figure 2:
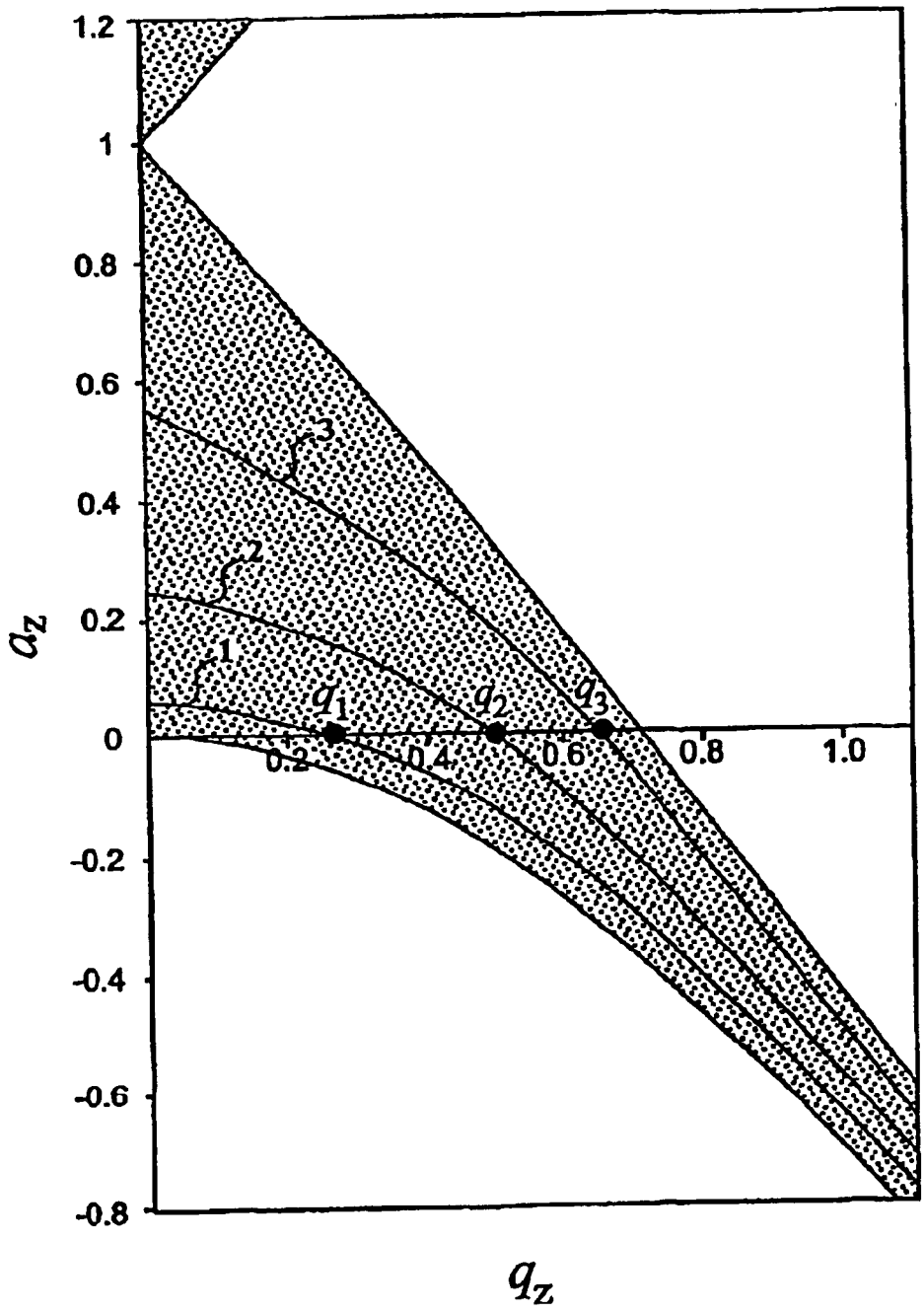
FIG. 2 shows an "a-q" stability diagram for ion motion in the z-direction of a rectangular wave driven quadrupole ion trap including instability lines created by varying the duty cycle of every 4th wave of the rectangular wave.

Application of the rectangular wave voltage to the ion trap causes a quadrupole trapping electric field to be formed inside the ion trap. The range of mass-to-charge ratios that can be trapped depends on different parameters of the rectangular wave voltage which may include a DC component U, an AC component V, frequency $\Omega=2\pi f$, duty cycle d and $r_0$, the radial dimension of the ion trap. For a standard quadrupole ion trap $r_0=\sqrt{2z_0}$, where $z_0$ is the spacing of the end cap electrodes in the z-axis direction. In a paper titled "Ion Motion in the Rectangular Wave Quadrupole Field and Digital Operation Mode of a Quadrupole Ion Trap Mass Spectrometer" published in the Chinese Vacuum Science and Technology, V20 3, 2001, Li Ding analysed ion motion in the rectangular wave quadrupole field using the traditional a,q parameters which were previously used to study Mathieu's equation (although Mathieu's equation is no longer suitable for the rectangular wave quadrupole field). For ion motion in the z direction, these parameters are defined as $$a_z = -\frac{8eU}{m\Omega^2 r_0^2}$$

$$q_z = \frac{4eV}{m\Omega^2 r_0^2},$$

where for a 50% duty cycle square wave, V is just the pulse height from low level to high level. FIG. 2 shows a stability diagram in which the stable region for motion in the z direction is shown shaded. In this stable region, ions oscillate in the z-direction with a limited amplitude and at certain oscillation frequencies and so are trapped within the ion trap. The intrinsic or secular frequency is the main frequency component of this oscillation, and was studied in paper 1 referenced above. In PCT/GB00/03964, a simplified expression for the case that the dc component U=0 was given as $$\omega_z = \frac{\Omega}{2\pi}\arccos\left[ch\left(\sqrt{\frac{q_z}{2}}\pi\right)\cos\left(\sqrt{\frac{q_z}{2}}\pi\right)\right]$$

As described in PCT/GB00/03964, by applying a voltage across the two end cap electrodes the trapped ions can be excited enhancing their movement in the z-axis direction. This is called dipole excitation. If the frequency of the dipole excitation voltage matches the intrinsic frequency of ion motion, resonance will occur and so ions with particular mass-to-charge ratio will undergo oscillatory motion which grows in amplitude in the z-axis direction with the result that those ions may be ejected through axial holes in the end cap electrodes. Mass analysis can thus be achieved by detecting these ejected ions while scanning either the rectangular wave drive frequency or the excitation frequency applied across the end cap electrodes, or both these frequencies in a fixed relation. This can be done digitally and has already been disclosed in PCT/GB00/03964.

The intrinsic oscillation can also be resonantly excited by application of an additional quadrupole field. In this case, an additional AC voltage can either be applied to the two end cap electrodes or superimposed on the driving rectangular wave voltage applied to the ring electrode. Because a quadrupole field accelerates ions in opposite directions on opposite sides of the ion trap with respect to the centre of the ion trap, resonance will occur if the frequency of this additional AC voltage is double the frequency of the intrinsic oscillation. This is clearly illustrated in FIG. 3 in which waveform (a) represents ion oscillation in the z-axis direction, waveform (c) shows a pulsed excitation voltage which is superimposed on the rectangular wave drive voltage (waveform (b)) applied to the ring electrode 4. As can be seen from FIG. 3 each excitation pulse gives rise to a defocusing force (shown by arrows in the drawing) causing oscillatory motion of ions in the z-axis direction to grow. FIG. 4 illustrates the effect of superimposing waveforms (b) and (c). In this illustration, the relative phases of the two waveforms are so chosen that every nth wave in the composite waveform (d) is slightly wider than the others, so increasing the duty cycle of that wave (in this example n=4), though clearly the superimposed waveforms may have a different phase relationship. Although the present invention embraces the foregoing technique involving the superimposition of separate waveforms (i.e. the time-varying rectangular wave drive voltage and a separate pulsed excitation voltage) waveform (d) of FIG. 4 can alternatively be derived, much more conveniently, directly from the digital control signal 2 alone, and this is the preferred technique. This approach obviates the need to generate an additional high voltage waveform which would then need to be superimposed on the rectangular wave voltage using additional circuitry.

Figure 3:
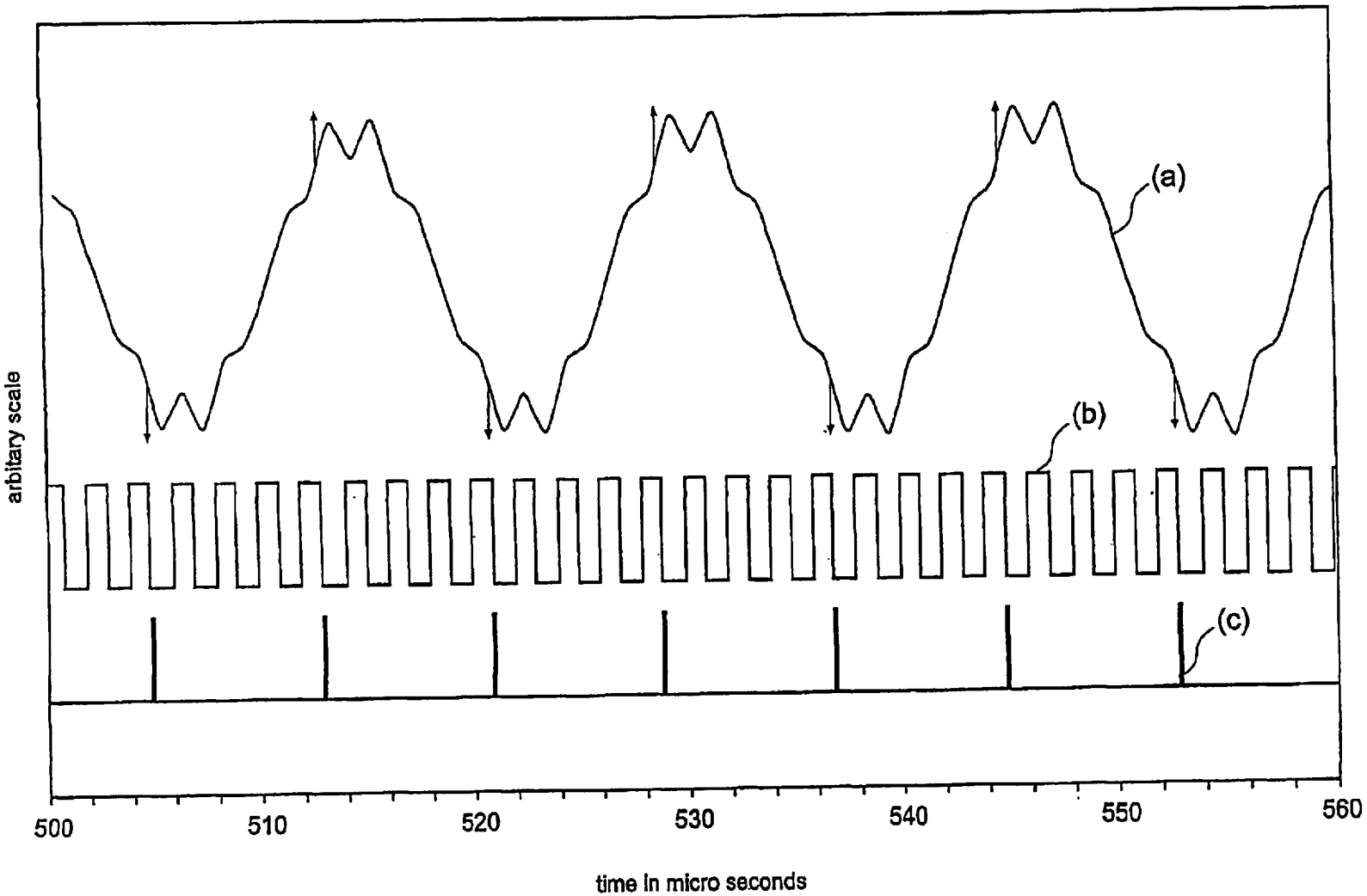
FIG. 3 shows how the amplitude of ion oscillation increases with time as excitation approaches resonance. The excitation voltage has a pulsed waveform and is superimposed on the driving rectangular waveform.
Figure 4:
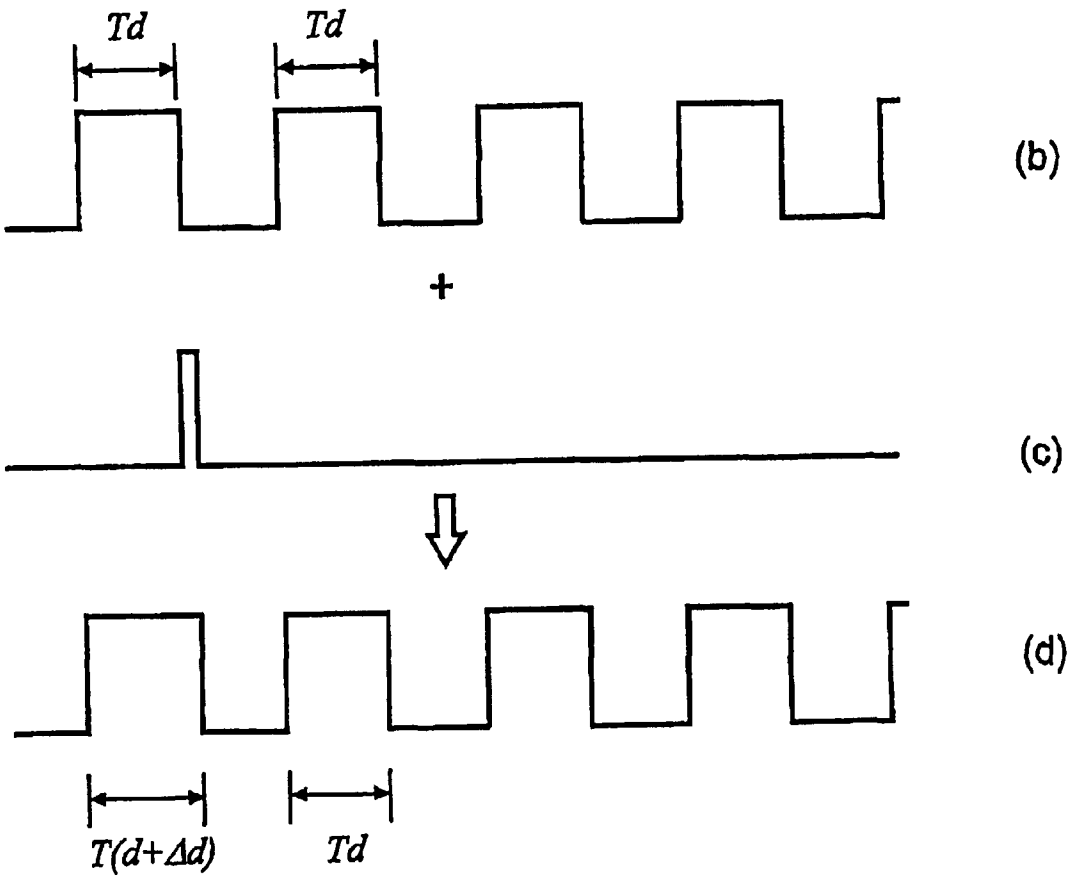
FIG. 4 illustrates the equivalence between the superimposition of two waveforms and duty cycle variation achieved solely by digital control.

In FIG. 3, the duty cycle of every 4th wave is increased in order to excite ions having an intrinsic frequency of $$\omega_z = \frac{1}{8}\Omega,$$

and this corresponds to a,q parameters lying on line 1 in FIG. 2, which crosses the q axis at $q_1=0.269$. Because the pulse excitation waveform contains higher order harmonic frequency components, oscillations at $$\omega_z = \frac{1}{4}\Omega, \quad \frac{3}{8}\Omega$$

will also be excited. In other words, this means that n−1 instability lines are created in the stability region when the duty cycle of every nth wave is modulated.

Figure 5:
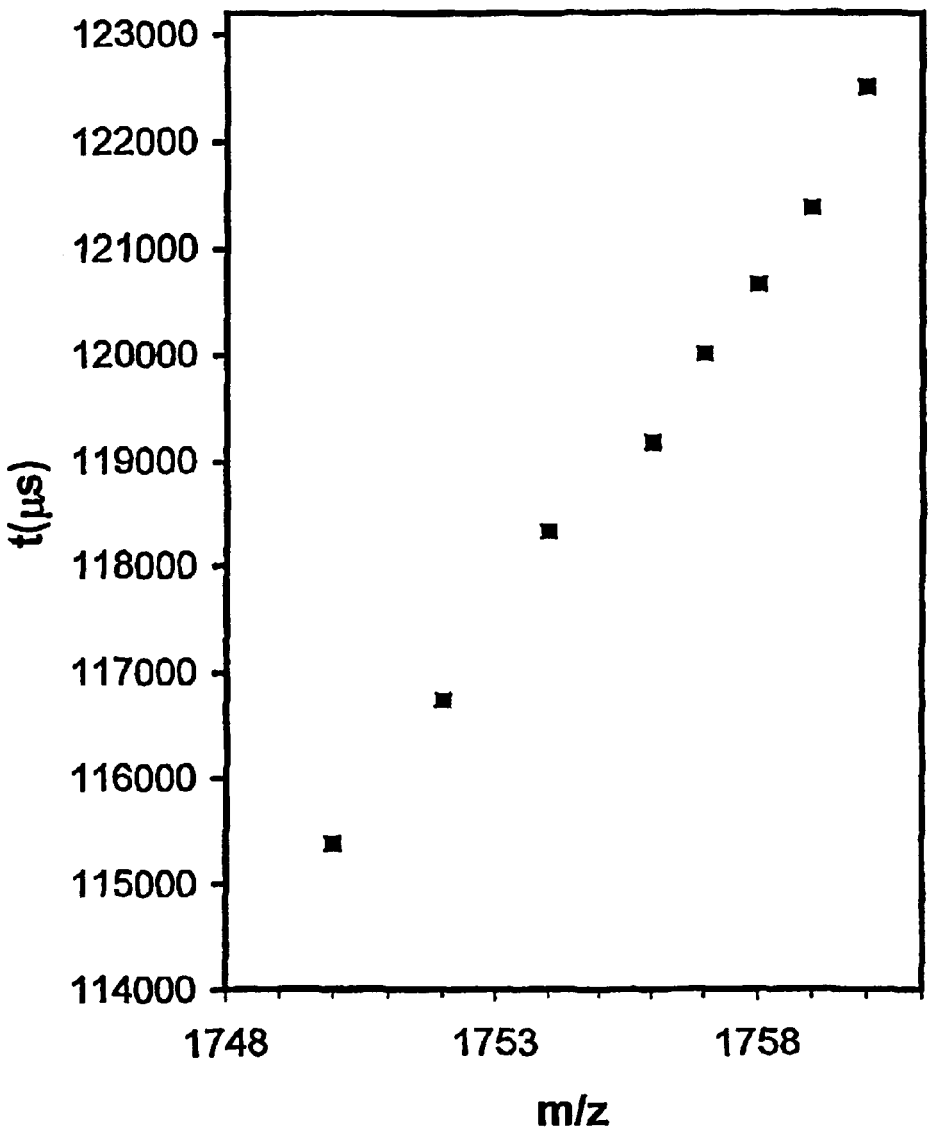
FIG. 5 shows a simulation result in which ions are ejected in sequence according to their mass-to-charge ratios.

In order to avoid spurious peaks caused by these higher order frequency resonances during mass scanning, the frequency of the rectangular wave needs to be adjusted to ensure that all trapped ions have values of a,q to the left of the first resonance line 1 before a mass scan is started. During mass scanning the frequency of the rectangular wave voltage is gradually decreased and the duty cycle is varied. The amount of the variation of the duty cycle should be enough to eject an ion when it approaches resonance. This will depend on the speed of mass scan which in turn depends on the mass resolution required for the mass analysis. Normally the amount of variation $$\frac{\Delta d}{d}$$

is smaller than 5%. FIG. 5 shows a computer simulation of a slow mass scanning process in which ions with different mass-to-charge ratios are ejected in sequence according to their mass-to-charge ratios. In this simulation, the duty cycle variation is only 2%. In order that all trapped ions are cooled down so that they occupy the middle of the ion trap before resonance ejection scanning starts, a buffer cooling gas may be introduced into the ion trap as part of the process. In the above simulation, He buffer gas at around $10^{-3}$ mbar pressure was taken into account.

The above embodiment only shows an example of this invention. In fact, there are many variants of the geometrical construction of a quadrupole ion trap. For example, the ion trap can be built to generate, as precisely as possible, the pure quadrupole electric field or to deliberately include high order electric fields (e.g. octupole field). It may be constructed using hyperboloid-shaped electrodes or a combination of flat and cylindrical-shaped electrodes. Also, the two end cap electrodes may be shaped and positioned asymmetrically, and differentially coupled to respective parts of the rectangular wave voltage. In this case, ions can be preferentially ejected from one side of the ion trap so that more ions will be detected by a charged particle detector placed on that side.

The main purpose of this invention is to carry out a mass scan in mass analysis, but using resonant ejection to dispel unwanted ions and retain the ions within a certain range of mass-to-charge ratio in the ion trap is also within the scope of this invention. Also the method disclosed herein can also be used in combination with, or assisted by, dipole excitation which can be easily achieved by applying a supplementary excitation voltage between the two end cap electrodes.

In the above illustration, the quadrupole ion trap is a rotationally symmetric ion trap, which is most commonly used. However, the ejection method can also be used with a linear quadrupole ion trap for the ejection of unwanted ions. In this case, the rectangular wave voltage is supplied to one pair of diagonally opposed electrodes and another pair of diagonally opposed electrodes is connected to a fixed potential or driven by a similar switch circuit which generates the rectangular wave voltage, but with reverse polarity. By suitably controlling the rectangular waveform shape, resonance along the x-direction and the y-direction can be made to happen at the same time or one after another.

What is claimed is:

1. A method for ejecting ions from a quadrupole ion trap including the steps of creating a digital control signal, using the digital control signal to control the dining of switching means to generate a time-varying rectangular wave voltage, supplying the time-varying rectangular wave voltage to the quadrupole ion trap to trap ions in a predetermined range of mass-to-charge ratio, and varying a duty cycle of every nth wave of the rectangular wave voltage, where n is an integer greater than unity, to cause ejection of trapped ions having a predetermined mass-to-charge ratio.

2. The method as claimed in claim 1 for analysis of mass-to-charge ratio of ions including, adjusting the frequency of said time-varying rectangular wave voltage to select a starting point for scanning mass-to-charge ratio, and then varying the frequency of the rectangular wave voltage while said duty cycle is being varied to cause ejection of trapped ions, in sequence, according to their mass-to-charge ratios.

3. The method as claimed in claim 1 wherein the step of creating the digital control signal includes:

subjecting clock pulses to digital signal processing to convert the clock pulses to an analogue signal, using filter means to smooth the analogue signal, and comparing the smoothed analogue signal with an adjustable threshold whereby to create said digital control signal as a result of the comparison.

4. The method as claimed in claim 1 wherein said switching means comprises two switches connected together in series between a source of a high DC voltage level and a source of a low DC voltage level, the switches being arranged to connect an output of the switching means to said high and low DC voltage level sources alternately in response to said digital control signal whereby to generate said time-varying rectangular wave voltage at said output.

5. The method as claimed in claim 1 wherein said variation of duty cycle is effected by said digital control signal.

6. The method as claimed in claim 1 wherein said rectangular wave voltage has no DC component.

7. The method as claimed in claim 2 wherein the said variation of duty cycle gives rise to n−1 resonance lines in an a-q stability diagram and said starting point is selected to ensure that the trapped ions all have values of q less than the smallest of the corresponding values on said resonance lines.

8. The method as claimed in claim 1 wherein the said variation of duty cycle is less than 5%.

9. The method as claimed in claim 1 wherein said variation of duty cycle is effected by means different from said digital control signal.

10. The method as claimed in claim 1 wherein the quadrupole ion trap is arranged to generate a pure quadrupole electric field and higher order multipole electric fields.

11. The method as claimed in claim 1 wherein said rectangular wave voltage is supplied to end cap electrodes of the quadrupole ion trap while a ring electrode is connected to a fixed potential.

12. The method as claimed in claim 1 wherein said rectangular wave voltage is supplied to a ring electrode of the quadrupole ion trap while end cap electrodes are connected to a fixed potential.

13. The method as claimed in claim 1 including applying an additional dipole electric field via end cap electrodes to assist quadrupole excitation.

14. The method as claimed in claim 1 wherein said quadrupole ion trap is a linear quadrupole ion trap.

15. The method as claimed in claim 2 wherein the step of creating the digital control signal includes:

subjecting clock pulses to digital signal processing to convert the clock pulses to an analogue signal, using filter means to smooth the analogue signal, and comparing the smoothed analogue signal with an adjustable threshold whereby to create said digital control signal as a result of the comparison.

16. An apparatus for ejecting ions from a quadruople ion trap including:

means for creating a digital control signal, switching means for generating a time-varying rectangular wave voltage in response to said digital control signal, the time-varying rectangular wave voltage being effective, when supplied to the quadrupole ion trap, to cause trapping of ions in a predetermined range of mass-to-charge ratio, and means for varying a duty cycle of every nth wave of the rectangular wave voltage, where n is an integer greater than unity, to cause ejection of trapped ions having a predetermined mass-to-charge ratio.

17. The apparatus as claimed in claim 16 for analysis of mass-to-charge ratio of ions wherein said means for creating a digital control signal is arranged to adjust the frequency of said time-varying rectangular wave voltage to select a starting point for scanning mass-to-charge ratio and then vary the frequency of the rectangular wave voltage while said duty cycle is being varied to cause ejection of trapped ions, in sequence, according to their mass-to-charge ratios.

18. The apparatus as claimed in claim 16 wherein said means for varying duty cycle is said means for creating a digital control signal.

19. The apparatus as claimed in claim 16 wherein said means for varying a duty cycle is different from said means for creating a digital control signal.

20. The apparatus as claimed in claim 16 wherein said means for creating a digital control signal includes digital signal processing means for converting clock pulses to an analogue signal, filter means for smoothing said analogue signal, and comparison means for comparing the smoothed analogue signal with an adjustable threshold whereby to create said digital control signal as a result of the comparison.

21. The apparatus as claimed in claim 20 wherein said digital processing means is a Digital Signal Processor or a Direct Digital Synthesiser.

22. The apparatus as claimed in claim 16 wherein said switching means comprises two switches connected together in series between a source of a high DC voltage level and a source of a low DC voltage level, the switches being arranged to connect an output of the switching means to said high and low DC voltage level sources alternately in response to said digital control signal whereby to generate said time-varying rectangular wave voltage at said output.

23. The apparatus as claimed in claim 16 wherein the time-varying rectangular wave voltage generated by said switching means has no DC component.

24. The apparatus as claimed in claim 17 wherein the variation of duty cycle gives rise to n−1 resonance lines in an a-q stability diagram, and said starting point is selected to ensure that the trapped ions all have values of q less than the smallest of the corresponding values on said resonance lines.

25. An apparatus as claimed in claim 16 wherein said variation of duty cycle is less than 5%.

26. An apparatus as claimed in claim 16 wherein the quadrupole ion trap further includes end caps, and the apparatus includes means to apply an additional dipole electric field via the end cap electrodes of the quadrupole ion trap to assist quadrupole excitation.

27. The quadrupole ion trap incorporating an apparatus as claimed in claim 16.

28. The quadrupole ion trap as claimed in claim 27 arranged to generate a pure quadrupole electric field or higher order multipole electric fields.

29. The quadrupole ion trap as claimed in claim 27 wherein said time-varying rectangular wave voltage is supplied to the end cap electrodes of the ion trap, the ion trap further includes a ring electrode, and the ring electrode of the ion trap is connected to a fixed potential.

30. The quadrupole ion trap as claimed in claim 27 further comprising a ring electrode, and wherein said time-varying rectangular wave voltage is supplied to the ring electrode of the ion trap and the end cap electrodes of the ion trap are connected to a fixed potential.

31. The quadrupole ion trap as claimed in claim 27 in the form of a linear quadrupole ion trap.

32. The apparatus as claimed in claim 17 wherein said means for varying a duty cycle is said means for creating a digital control signal.

33. The apparatus as claimed in claim 17 wherein said means for varying a duty cycle is different from said means for creating a digital control signal.

* * * * *